US006367535B1

(12) United States Patent
Chouinard

(10) Patent No.: US 6,367,535 B1
(45) Date of Patent: Apr. 9, 2002

(54) KNEELER DEVICE FOR USE IN MAKING CARPET SEAMS

(76) Inventor: Michael Richard Chouinard, 7659 Co. Rd. 426 M.5 Rd., Gladstone, MI (US) 49837

( * ) Notice: Subject to any disclaimer, the term of this patent is extended or adjusted under 35 U.S.C. 154(b) by 867 days.

(21) Appl. No.: 08/659,380

(22) Filed: Jun. 6, 1996

(51) Int. Cl.[7] ..... B32B 35/00
(52) U.S. Cl. ..... 156/576; 156/545; 156/579
(58) Field of Search ..... 156/304.4, 304.7, 156/391, 545, 574, 579; 280/1.22, 32.5, 32.6; D8/15, 16, 19; D12/6, 7, 8, 9, 10, 11; D21/228

(56) References Cited

U.S. PATENT DOCUMENTS 1,382,883 A * 6/1921 Ashbridge ..... 280/32.5
1,529,498 A * 3/1925 Novak ..... 280/32.5
2,318,059 A * 5/1943 Cooper ..... 280/32.5
2,448,427 A * 8/1948 Gordon ..... 280/32.5
2,677,410 A 5/1954 Reinhard ..... 156/391
2,738,200 A * 3/1956 De Haven ..... 280/32.5
3,619,333 A 11/1971 Mender ..... 156/579
3,908,198 A * 9/1975 Brock
4,584,040 A 4/1986 Anderson ..... 156/152
4,613,396 A 9/1986 Scarborough ..... 156/391
4,617,083 A 10/1986 Vrizarris ..... 156/545
4,780,173 A 10/1988 Wentz ..... 156/574
D319,272 S * 8/1991 Rushatz et al. ..... D21/191

* cited by examiner

*Primary Examiner*—Curtis Mayes
(74) *Attorney, Agent, or Firm*—John R. Benefiel

(57) ABSTRACT

A kneeler device for use in applying pressure when making carpet seams includes a rectangular board member formed with a knee receiving curved recess at its forward end and toe ridges at the rear to allow a user to comfortably kneel on the upper surface and advance the member along the seam. The recess may be padded and the toe ridges adjustable.

11 Claims, 1 Drawing Sheet

KNEELER DEVICE FOR USE IN MAKING CARPET SEAMS

BACKGROUND OF THE INVENTION

This invention concerns a device useful in carpet laying and more particularly in making seams. Seams are now usually made using a hot glue seaming tape which is positioned beneath adjacent carpet sections to be joined with a heating iron moved along its length to melt adhesive on the upper face of the tape. The carpet sections are pushed together and pressed into the adhesive just behind the heating iron.

Carpet layers often stand on a tool box to exert pressure on the carpet section to insure that the adhesive is pressed into the carpet backing, but this technique is not convenient or particularly effective.

U.S. Pat. No. 4,780,173 issued on Oct. 25, 1988 for a "Carpet Seam Finishing Tool" describes a tool comprised of hinged bodies which are knelt on to exert a bonding pressure on the carpet sections.

However, that device is not any more convenient, comfortable, or efficient to use than the tool box. In fact, that device has the disadvantage of blocking a user's view of the seam, due to its shape at the front which curves under the upper surface on which a user kneels.

A sharp edge on the bottom creates a tendency for glue to mat down the carpet fibers into the glue, making the seam more apparent.

Accordingly, it is the object of the present invention to provide a device for exerting pressure on joined carpet sections which is convenient and comfortable to use, and allows the seaming process to be efficiently carried out.

SUMMARY OF THE INVENTION

This object is achieved by an elongated board-like member having a flat unencumbered bottom enabling pressure to be exerted on a carpet seam under the weight of one leg of the user. The member is of sufficient width to enable kneeling thereon on one leg by a carpet layer. The front end of the member has a curved recess extending across its width terminating in a ridge at the front edge able to be engaged with the top of the user's knee with the knee resting in the recess. The recess is preferably padded to reduce the pressure on the bent knee.

A curved hump blending into the recess may also aid in fitting the member to the user's shin and knee.

The ridge enables the member to be scooted along by a simple leg motion to be easily advanced along the carpet seam without use of the hands.

The front edge of the member is squared off to allow good visibility of the carpet joint as it passes under the flat bottom of the member, allowing the carpet layer to inspect and adjust the joint as necessary.

Toe ridges are also provided to restrain the foot from straightening and to aid the user in hands-free advancing of the member as the carpet layer moves along the seam, and also to engage the toe of his or her shoe to resist any tendency for the foot to straighten and cause cramping.

The lengthwise position toe ridges are preferably adjustable to adapt the device to persons of different size.

Venting holes are preferably formed in the member to assist the venting of steam and to speed cooling of the glue.

A carrying handle may be formed by a crosswise slot at the rear end.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
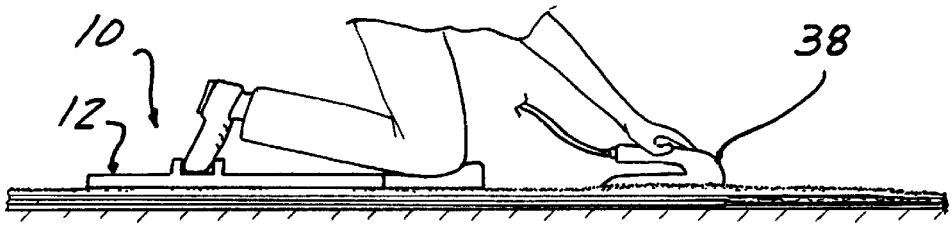
FIG. 1 is a side elevational view of a kneeler device according to the present invention in use by a carpet layer.
Figure 2:
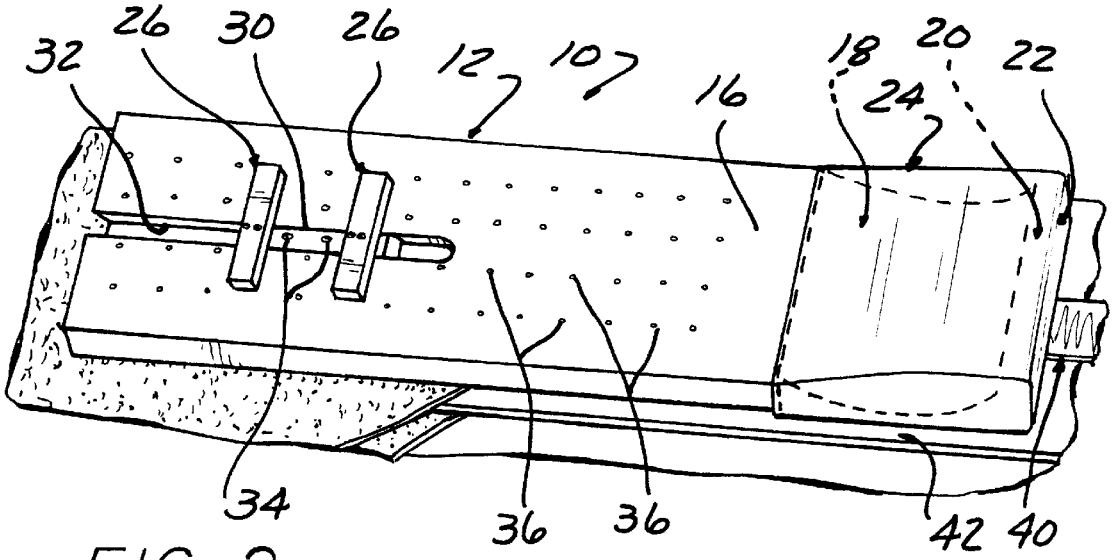
FIG. 2 is an enlarged perspective view of the kneeler device shown in FIG. 1 showing fragmentary portions of adjacent sections of carpet, pad, and a backup board.

Referring to the drawings and particularly FIGS. 1 and 2, a kneeler device 10 according to the invention comprises an elongated board-like rigid member 12 of generally rectangular shape, having a width so as to readily enable kneeling on the upper surface with the bent knee of one leg at the forward end 14, and the lower leg and foot extending to the rear and also supported on the upper surface 16. A width on the order of six or more inches and a length of two feet or longer will enable comfortable use by most persons. The bottom of member 12 is flat and unencumbered to be free of obstructions so as to lie flat on carpet to enable pressure to be exerted across and along a carpet seam by the weight of the user.

A curved recess 18 extends across the width of member 12 at the forward end thereof, leaving a ridge 20 at the leading edge 22. A padded covering 24 overlies the recess 18 which reduces the pressure felt when the user's weight is supported on one knee positioned atop the covering 24, the padding compressing sufficiently so that the knee moves partially behind the ridge 20.

Figure 2A:
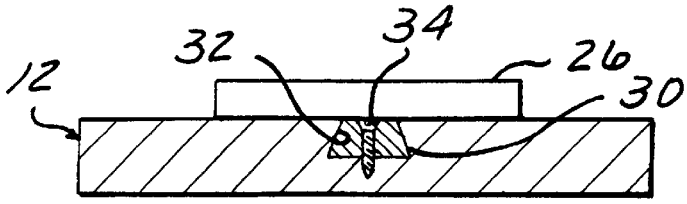
FIG. 2A is a view of a transverse section taken through the kneeler device to show the mounting of one of the toe ridges.

A pair of longitudinally spaced apart toe ridges 26, 28 extend crossways to the length of the member 12 at the approximate location of the toe of the user's shoe when the knee is positioned in the recess 18. The toe ridges 26, 28 are preferably mounted on a slider 30 movable in a lengthwise dovetail slot 32 (FIG. 2A) so as to allow adjustment of its location to match the mating of the user. The slider 30 is able to be fixed in any adjusted position as by screws 34.

The rearmost toe ridge 26 restrains the foot of the user from a tendency to straighten and create discomfort and cramping, while the forward ridge 28 enables the user to scoot the member 12 by hooking of the shoe toe and advancing leg movement. The forward ridge 20 can also be used to an advantage in this maneuver. thus, hands-free advance of the member 12 is conveniently enabled.

A pattern of a plurality of through holes 36 penetrate the member 12 to allow venting of steam to speed cooling of the hot melt adhesive.

In use, the device 10 is placed lengthwise in alignment with a seam to be made between two carpet sections. A heating iron 38 is moved along atop the carpet tape 40 with adjacent sections of carpet above each side of the heating iron 38 in conventional fashion.

The user has the bottom of his or her knee pressed into the recess 18 and the toe of his or her shoe inserted in the space between the toe ridges 26, 28.

The pressure applied to the forward end is used to apply pressure with the flat bottom of the member to the carpet edges above the just heated segments of the tap 40.

The forward edge 22 is squared off to afford a good view of the seam just prior to passing under the member 12 to be pressed into the heated adhesive.

The device 10 is conveniently advanced without use of the hands by leg movement by means of the user's engagement of the toe ridges 26, 28 and/or forward ridge 20.

Preferably, a backer board 42 comprised of a thin sheet of plywood is placed below the carpet tape 40 to insure solid application of pressure of the carpet underside to the tape.

The configuration of the kneeler device is such as to result in only minimal pressure on the user's leg to insure allow comfort even during sustained use during the making of carpet seams. The device is also very efficient in affording excellent quality seams to be made quickly with reduced effort in comparison to past practices.

Figure 3:
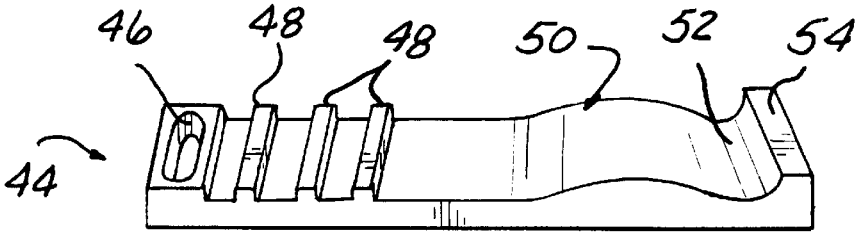
FIG. 3 is a perspective view of a kneeler device according to the present invention of an alternate configuration.

FIG. 3 illustrates variations in the kneeling device 44 which are possible. A carrying handle is created by a crosswise extending slot 46 at the rear edge.

A series of spaced apart fixed toe ridges 48 can be provided rather than the position adjustability described above.

A gently curved hump 50 blends into the forward recess 52 bounded by the forward ridge 54 to comfortably fit the device to the user's knee without padding.

Many other variations are of course possible.

The member 12 can be constructed of various materials, such as finished wood, molded plastic, etc. in the interest of ease of manufacture, as will be appreciated by those skilled in the art.

What is claimed is:

1. A kneeler device for use in making carpet seams comprising:

an elongated, generally rectangular rigid member of a width sufficient to accommodate only one knee of a user kneeling thereon with one knee, said member having a flat bottom unencumbered with obstructions so as to enable exerting pressure by the flat bottom extending across a carpet seam and under at least part of the weight of the user having one knee resting atop the member at a forward location thereon;

a curved recess formed into an upper surface at said forward end of said member adapted to receive the bent knee of the user, with a forward ridge extending across the width of the member at a forward edge of said forward ridge, whereby a user can move said member forward along a seam solely by leg movement and engagement with said bent knee.

2. The kneeler device according to claim 1 wherein said member is of sufficient length to support a downwardly extending toe of a shoe worn by a user kneeling thereon, with the bent knee in said recess.

3. The kneeler device according to claim 2 further including at least one toe ridge affixed to the upper surface of said member and extending across the width thereof at a location to be engaged with said user's toe.

4. The kneeler device according to claim 3 wherein said toe ridge is mounted to said member to be adjustable longitudinally to be able to be shifted to said location.

5. The kneeler device according to claim 3 wherein a pair of longitudinally spaced toe ridges are provided, with said toe of said shoe received in said space therebetween.

6. The kneeler device according to claim 3 wherein a series of longitudinally spaced apart fixed toe ridges are provided on said member upper surface.

7. The kneeler device according to claim 2 wherein a compressible pad is mounted in said recess.

8. The kneeler device according to claim 2 wherein said member has a squared off forward end.

9. The kneeler device according to claim 1 wherein a gently curving hump is formed on said member upper surface blending into said recess.

10. The kneeler device according to claim 1 wherein a crosswise through slot is formed in said member to provide a carrying handle.

11. The kneeler device according to claim 1 wherein said member is formed with a series of through perforations to vent heated air and allow more rapid cooling of said carpet seam.

* * * * *